US006140990A

United States Patent [19]

Schlig

[11] Patent Number: 6,140,990

[45] Date of Patent: Oct. 31, 2000

[54] ACTIVE MATRIX LIQUID CRYSTAL DISPLAY INCORPORATING PIXEL INVERSION WITH REDUCED DRIVE PULSE AMPLITUDES

[75] Inventor: Eugene S. Schlig, Somers, N.Y.

[73] Assignee: International Business Machines Corporation, Armonk, N.Y.

[21] Appl. No.: 09/174,533

[22] Filed: Oct. 16, 1998

[51] Int. Cl.[7] ..... G09G 3/36

[52] U.S. Cl. ..... 345/92; 345/94; 345/98; 345/99

[58] Field of Search ..... 345/90–100

[56] References Cited

U.S. PATENT DOCUMENTS 5,247,289 9/1993 Matsueda ..... 345/98
5,790,090 8/1998 Libsch et al. .

*Primary Examiner*—Bipin Shalwala
*Assistant Examiner*—David L. Lewis
*Attorney, Agent, or Firm*—Scully, Scott, Murphy & Presser; David M. Shofi, Esq.

[57] ABSTRACT

An AMLCD display and bootstrapped pixel drive method incorporating pixel inversion. Each of a plurality of pixel assemblies arranged in a matrix of rows and columns includes a display element having a display electrode, and a semiconductor device having a control port, an input port and an output port, with each output port connected to a corresponding display electrode. Each of a plurality of bootstrap lines are additionally connected to a display electrodes of a plurality of rows of pixel assemblies, and a data line connects each input ports of pixels arranged along a column. A plurality of gate lines is provided with each gate line associated with a row of pixels in the matrix and connected to control ports of pixel assemblies in the row for receiving gate line pulses. The control ports of semiconductor devices associated with pixels located on two adjacent rows are alternately connected to either one of two associated gate lines in an interleaved fashion. A bootstrap pulse in timed relation with gate line pulses applied to each of two gate lines associated with the pixels of two adjacent rows is applied to the bootstrap lines in a timed relation such that display electrodes of alternately connected interleaved pixels of two adjacent rows shift in voltage in a first time frame and successive time frames, and enables display electrodes of remaining alternately connected interleaved pixels of two adjacent rows of pixels to shift in voltage in a second time frame and successive second time frames.

11 Claims, 6 Drawing Sheets

PIXEL BOOSTRAPPING WITH PIXEL INVERSION.
NO GATE LINE CROSSOVERS WITHIN ARRAY

AMLCD array incorporating pixel bootstrapping with column inversion.

ACTIVE MATRIX LIQUID CRYSTAL DISPLAY INCORPORATING PIXEL INVERSION WITH REDUCED DRIVE PULSE AMPLITUDES

BACKGROUND OF THE INVENTION

1. Field of the Invention

The present invention is directed to an active matrix liquid crystal display (AMLCD) and a method for driving thereof, and more particularly, to an AMLCD incorporating pixel inversion with reduced drive pulse amplitudes.

2. Discussion of the Prior Art

FIG. 1 illustrates a conventional AMLCD circuit 10 such as described in U.S. Pat. No. 5,790,090 directed to a bootstrapped pixel method permitting the use of lower-voltage data drivers and low drive pulse amplitudes.

In the AMLCD device of FIG. 1, a display 1 comprising pixel assemblies 14 is arranged in a matrix of rows 12 labeled A, . . . ,D . . . , and columns 13. Each pixel assembly 14 includes a display element 5 having a display electrode 5A, and a semiconductor device, e.g., a metal-oxide-semiconductor field effect transistor or a thin-film transistor (TFT), Q, having a control port 3, an input port 2, and an output port 4. Each of the output ports is connected to a corresponding display electrode 5A. A plurality of bootstrap 11, gate, and data lines are provided, with each bootstrap line 11 connected, e.g., capacitively connected, via capacitor 7, to the display electrodes 5A of two rows (by way of example) of pixel assemblies. Each gate line is connected to the control ports 3 arranged in one of the rows. In addition, each data line is connected to the input ports 2 arranged in one of the column. Sharing bootstrap lines between two or more rows reduces the number of bootstrap lines to half, or less than half, the number of gate lines. Each bootstrap line is connected to a bootstrap pulse timing and generating circuit to provide a bootstrap pulse that shifts voltages on the pixel or display electrodes 5 in only one direction, e.g. in the positive direction, relative to a common electrode 6. The bootstrap pulse drive method as described in U.S. Pat. No. 5,790,090, enables operation of AMLCD reflective projection light valves implementing narrow line-width MOS technologies with reduced data line voltage and the gate line voltages, in addition to a low pixel voltage and a fixed common electrode voltage.

The method of frame inversion in pixel displays involves applying signal voltages to each pixel of the array of the same polarity relative to the common electrode voltage during each frame, and inverting the polarity each new frame. This method is desirable with small pixels because it minimizes visual artifacts due to crystalline disclination, but it is vulnerable to flicker and crosstalk. In pixel inversion, the polarity is inverted by pixel in each row, by row and by frame. Pixel inversion is generally regarded as best with respect to flicker and crosstalk. Inversion by either row or column as well as by frame are approximately equivalent and intermediate in performance between frame and pixel inversion.

It is thus highly desirable to incorporate a pixel inversion scheme in the bootstrapped pixel method of the AMLCD device shown in FIG. 1.

SUMMARY OF THE INVENTION

It is thus an object of the present invention to implement pixel inversion in an Active Matrix Liquid Crystal Display (AMLCD) device incorporating bootstrapped pixel drive method enabling reduced gate line voltage and data line voltages for driving rows of pixels in matrix arrays incorporating pixel inversion.

Another object of the present invention is to provide an Active Matrix Liquid Crystal Display (AMLCD) device incorporating a bootstrapped pixel drive methodology with a novel pixel inversion scheme for application to liquid-crystal-on-silicon reflective and transmissive (backlit) projection light valves, as well as direct view liquid crystal displays.

According to the principles of the invention, there is provided a display comprising: a plurality of pixel assemblies arranged in a matrix of rows and columns, each of the pixel assemblies including a display element having a display electrode, and a semiconductor device having a control port, an input port and an output port, each of the output ports being connected to a corresponding display electrode; a plurality of bootstrap lines each bootstrap line connected to the display electrodes of at least a row of the pixel assemblies; a plurality of data lines each connected to the input ports arranged in one of the columns; a plurality of gate lines with each gate line associated with a row of pixels in the matrix and connected to control ports of pixel assemblies in the row for receiving gate line pulses, the control ports of semiconductor devices associated with pixels located on two adjacent rows being alternately connected to either one of two associated gate lines in an interleaved fashion; and a plurality of bootstrap pulse timing and generating circuits, each connected to at least a bootstrap line to provide a bootstrap pulse in timed relation with gate line pulses applied to each of two gate lines associated with said pixels of two adjacent rows, wherein the timing relationship causes display electrodes of alternately connected interleaved pixels of said two adjacent rows to shift in voltage in a first time frame and successive first time frames, and enabling display electrodes of remaining alternately connected interleaved pixels of the two adjacent rows of pixels to shift in voltage in a second time frame and successive second time frames.

BRIEF DESCRIPTION OF THE DRAWINGS

Further features and advantages of the invention will become more readily apparent from a consideration of the following detailed description set forth with reference to the accompanying drawings, which specify and show preferred embodiments of the invention, wherein like elements are designated by identical references throughout the drawings; and in which.

DESCRIPTION OF THE PREFERRED EMBODIMENTS

Figure 1:
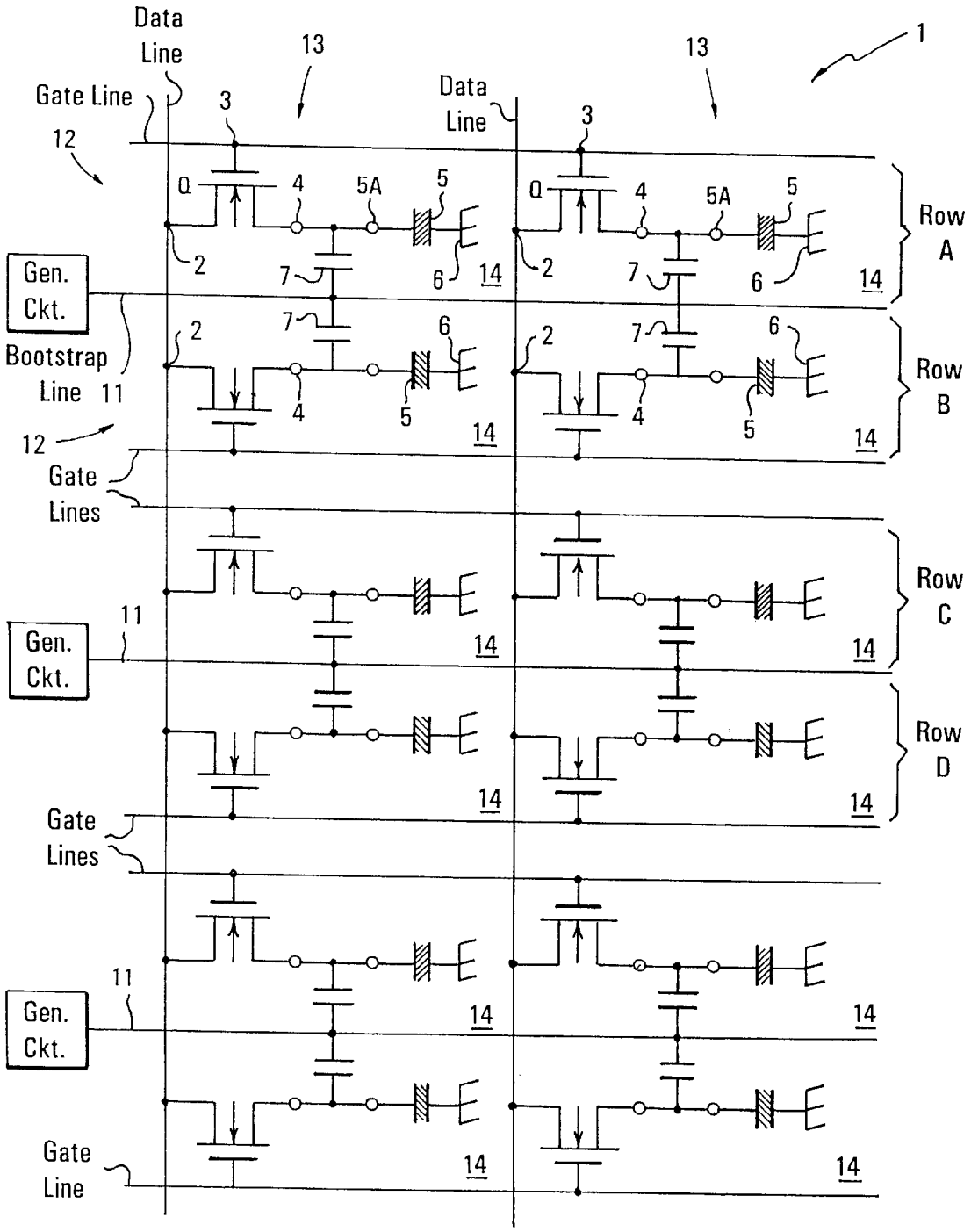
Fig. 1 (PRIOR ART)
FIG. 1 illustrates the AMLCD circuit 10 incorporating bootstrapped pixel method such as described in U.S. Pat. No. 5,790,090.
Figure 2:
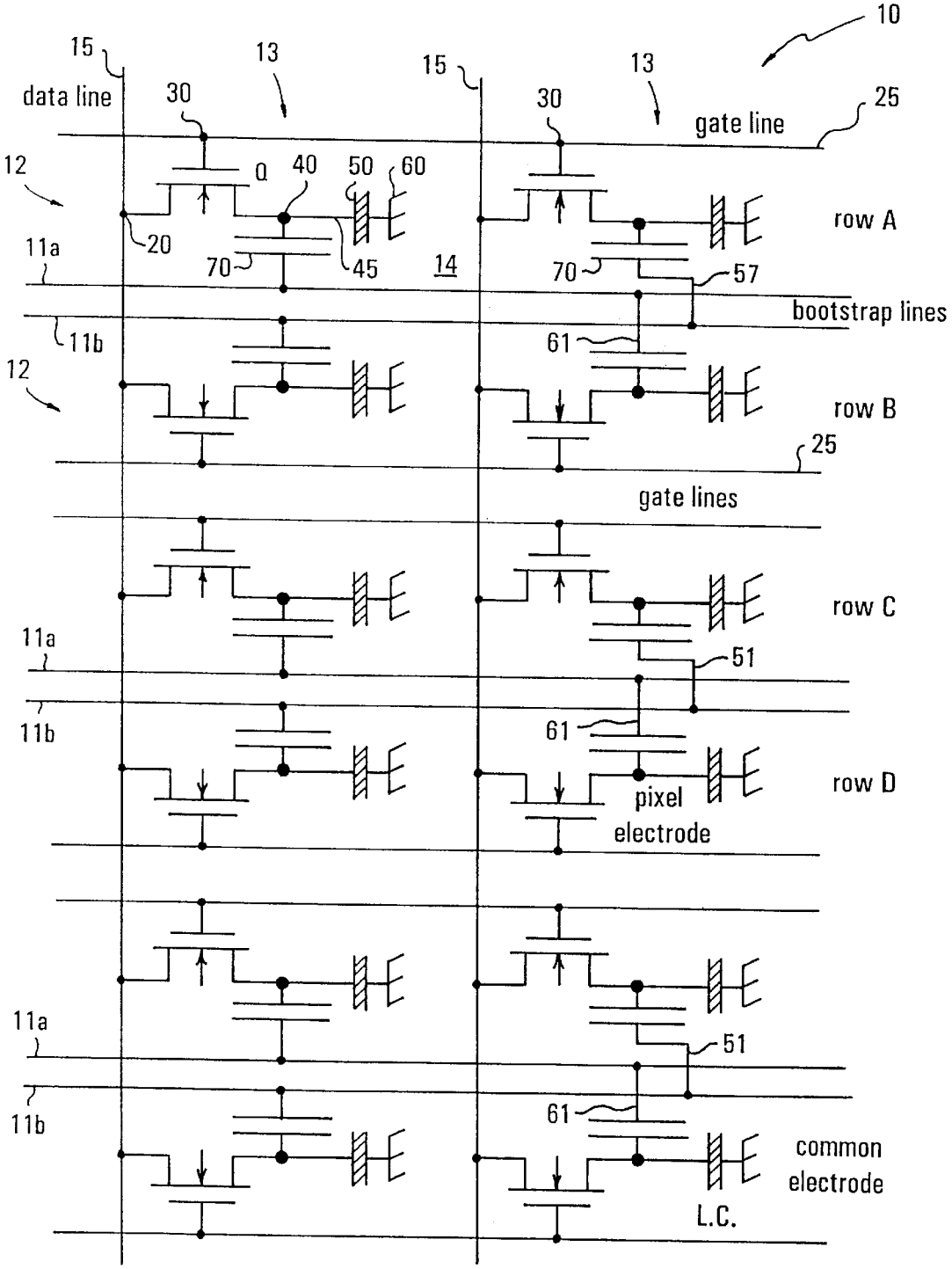
FIG. 2 illustrates the AMLCD display apparatus incorporating pixel inversion according to a first embodiment of the invention.

FIG. 2 is an illustration of a first structure and method for incorporating pixel inversion in the AMLCD array bootstrapped pixel drive method as disclosed in U.S. Pat. No. 5,790,090.

According to the first embodiment of the present invention, as shown in FIG. 2, the AMLCD array 10 comprises rows 12 and columns 13 of pixel assemblies 14 arranged as a matrix. Each pixel assembly 14 includes display elements or pixels 50, and a semiconductor device Q. Each pixel 50 has a display or pixel electrode 45 and a counter electrode 60. Illustratively, the counter electrodes 60 are connected together and are referred to as a common electrode. The display or pixel electrode 45 of each display elements or pixel 50 is connected to an output 40 of a corresponding semiconductor device Q, such as a thin film transistor (TFT), for example. A data line 15 connects inputs 20 of a column 13 of TFTs Q, and a gate line 25 connects transistor control ports, e.g., gates 30, of a row 12 of TFTs Q. Each TFT column and row has its own dedicated data and gate lines 15, 25, respectively, with the gate lines 25 providing gate pulses to control switching of the TFT's Q.

Additional bootstrap lines 11*a,b*, thread the array parallel to the gate lines 25, and are connected, e.g., capacitively coupled, to corresponding pixel electrodes 45 arranged in rows. Generally, the bootstrap line 11*a* is associated with row A pixels and bootstrap line 11*b* is associated with row B pixels each with a capacitor 70 functioning to couple bootstrap pulses from the bootstrap lines 11*a,b*, to the respective pixel electrodes 45. However, as shown in FIG. 2, the connection of the bootstrap lines 11*a* and 11*b* are interleaved in a manner such that successive alternate pixels of row A, for example, are capacitively connected to bootstrap line 11*b* by connection 51, and alternate pixels of row B, for example, are capacitively connected to bootstrap line 11*a* by connection 61 throughout the matrix. According to the teachings of U.S. Pat. No. 5,790,090, applying signal voltages to each pixel of the array of the same polarity relative to the common electrode voltage during each frame, and inverting the polarity each new frame (frame inversion) or, inverting the polarity of a pixel in each row, by row and by frame, is readily achieved.

In this first embodiment, the use of two bootstrap lines in this interleaved manner to achieve pixel inversion, is not accommodated efficiently. This is because it is necessary to interleave two row-wise bootstrap conductors by pixel along each pixel row, and, in the usual array technologies, this creates topological problems necessitating significantly larger pixel sizes in order to avoid performance degradation. Particularly, for the bootstrapping method to realize its drive voltage advantages, the capacitance from the bootstrap lines to its pixel electrodes must be a large fraction of the total capacitance and the same for all the pixels. However, the capacitance of the bootstrap lines to other pixel electrodes and other bootstrap lines must be very low. Additionally, the resistance of the bootstrap lines must be low enough to provide fast settling of transient voltages on the bootstrap lines. The bootstrap-line-to-pixel capacitor plates all must be on the same conductor level for the large and identical capacitance requirements, and the bootstrap lines must be wide for the low resistance requirement. As shown in the AMLCD display of FIG. 2, the bootstrap lines cannot underlie all pixels of each row, so space would need to be taken for wide bootstrap lines between rows with very low capacitance to adjacent pixels, and for bootstrap-line-to-bootstrap-capacitor-plate connections. This is achievable only if large pixel sizes are implemented, but may lead to topological problems for small pixel designs.

Figure 3:
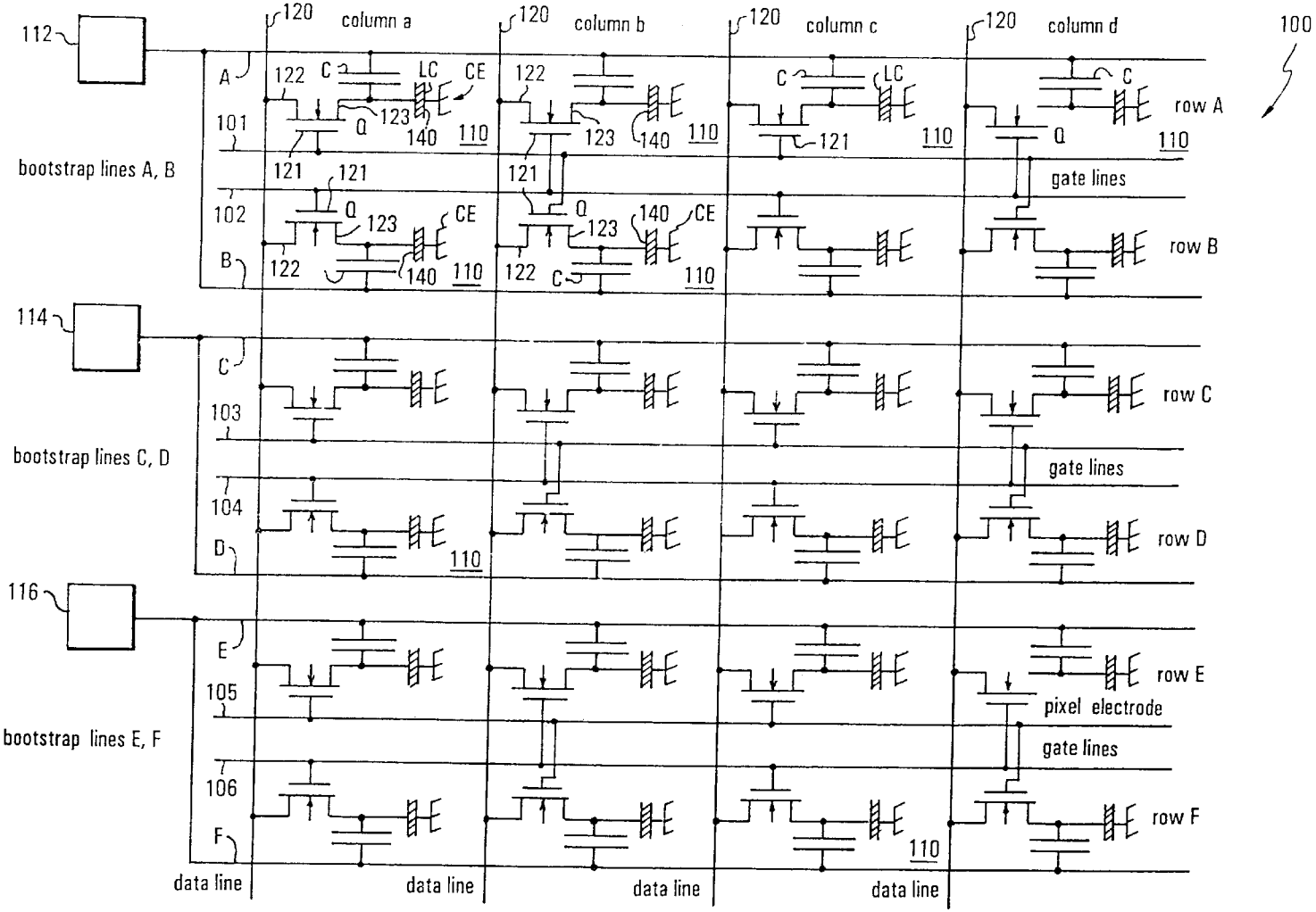
FIG. 3 illustrates the AMLCD display apparatus incorporating pixel inversion according to a preferred embodiment of the invention.

An AMLCD pixel array structure 100 incorporating bootstrapped pixel drive and implementing pixel inversion according to a preferred embodiment of the invention, is shown schematically in FIG. 3. As shown in the structure of FIG. 3, pixels 110 are arranged in rows A through F and columns "a" through "d" are served by gate lines 101 through 106. Bootstrap lines A through F serve respective pixel rows A-F with bootstrap lines A,B having a common bootstrap signal drive circuit 112. Bootstrap lines C,D have a common bootstrap signal drive circuit 114 and bootstrap lines E,F have a common bootstrap signal drive circuit 116. Each column a–d is provided with a data line 120. Preferably, each pixel assembly 110 comprises a transistor Q, for instance, an NMOS transistor, having a gate terminal 121, data input 122 and output terminals 123, and further includes a pixel electrode 140 having a large capacitance "C" to a bootstrap line, as well as various (unavoidable) stray capacitances (not illustrated). The potential between the pixel electrode 140 and the common electrode labeled "CE" controls liquid crystal pixel LC.

More particularly, as shown in FIG. 3, the gates 121 of successive pixel transistors Q on a row are connected to either of two gate lines in an interleaved fashion. That is, gates 121 of transistors Q for pixel assemblies located at row A, columns b and d are connected to gate line 102, and the gates 121 of transistors Q for pixel assemblies located at row A, columns a and c, are connected to gate line 101. Likewise, gates 121 of transistors Q for pixel assemblies located at row B, columns b and d, are connected to gate line 101, and the gates 121 of transistors Q for pixel assemblies located at row B, columns a and c, are connected to gate line 102. Connections alternate in this way across the row for each row pair of the pixel matrix. Thus, gates 121 of transistors Q for pixel assemblies located at row C, columns b and d, are connected to gate line 104, and the gates 121 of transistors Q for pixel assemblies located at row C, columns a and c, are connected to gate line 103. Likewise, gates 121 of transistors Q for pixel assemblies located at row D, columns b and d, are connected to gate line 103, and the gates 121 of transistors Q for pixel assemblies located at row D, columns a and c, are connected to gate line 104. As shown in FIG. 3, the same gate interleave scheme is present in rows E and F, and continues for the whole pixel array matrix.

As a result of the aforementioned interleaving scheme, it may be seen in FIG. 3 that the gates 121 of transistors Q of pixel assemblies in all rows, columns b and d, do not connect to their nearest gate lines, but cross the nearest gate lines to connect to next nearest gate lines. It should be noted that FIG. 3 is a schematic diagram of electrical connections, which may be achieved by a variety of physical layouts.

Figure 4:
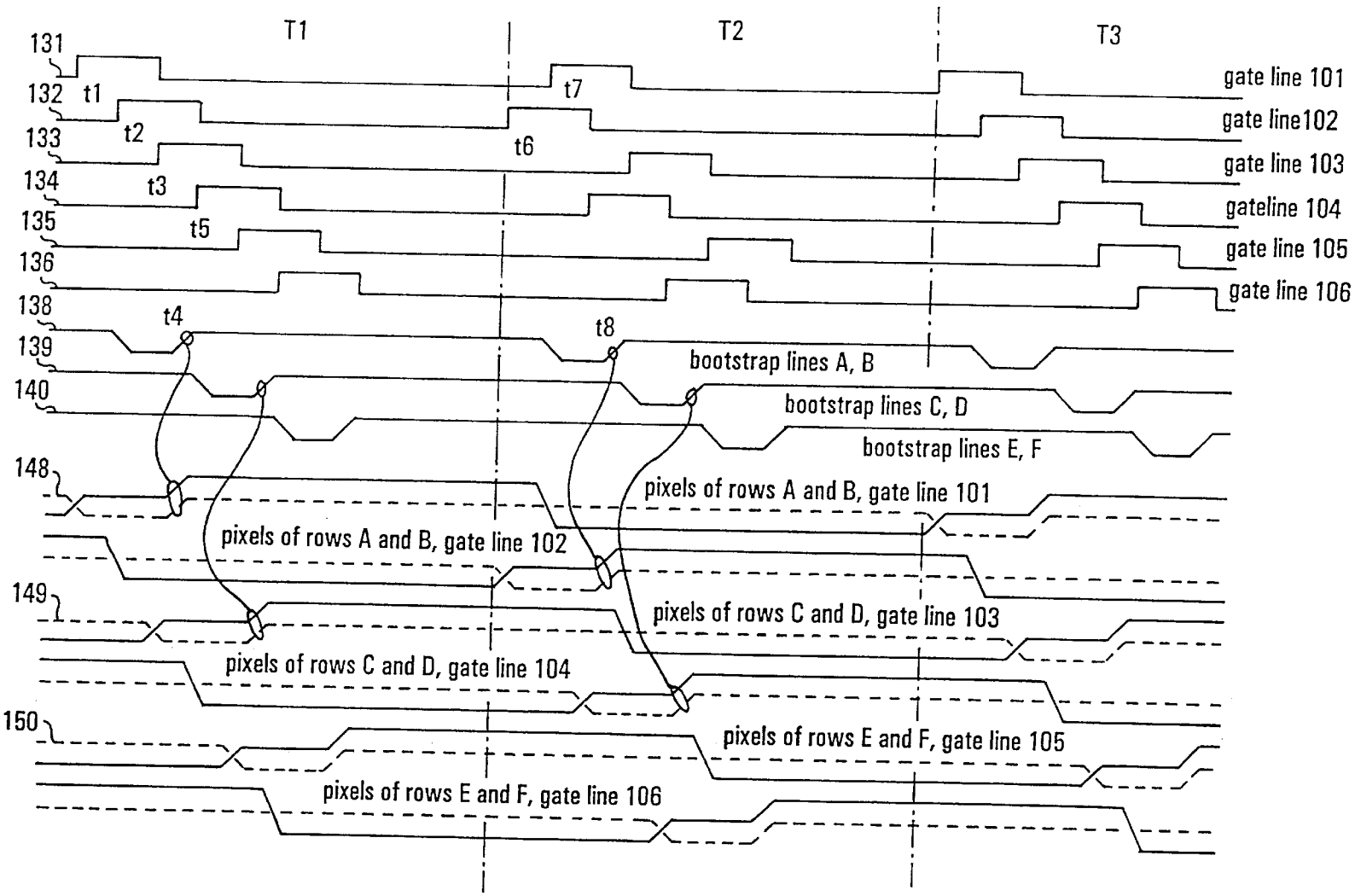
FIG. 4 depicts an example timing diagram for signals generated in the AMLCD pixel display apparatus according to the preferred embodiment of the invention.

By way of example, FIG. 4 illustrates a timing diagram for the display of FIG. 3 of the signals 131–136 present on respective gate lines 101–106 for three frames T1–T3. Additionally, as shown are respective bootstrap signals on bootstrap lines A–F, and the voltages across pixel electrodes 140 for each of the pixels in rows A–F. As illustrated in FIG. 4, the pixel electrode signals are for the two extremes of display luminance, represented by solid and broken lines. The common electrode is at a dc level midway between the highest and lowest pixel voltage excursion.

In FIG. 4, a gate pulse 131 appears on gate line 101 at time t1 and on gate line 102 at time t2. While the gate pulses are up, the corresponding pixel electrodes are charged to corresponding data line voltages through the pixel transistors Q. While both gate pulses are present (alternatively, immediately before one or both), the voltage 138 on bootstrap lines A and B falls. At this time, the pixel electrodes are clamped to the corresponding data lines through the transistors, so their voltages are unaffected (except transiently). At t3, the gate line 101 pulse ends but the gate line 102 pulse remains high, so gate line 101 transistors turn off. At t4, immediately after t3, the voltage 138 on bootstrap lines A and B rises. As shown in FIG. 4, the pixel electrode potentials 148 for pixels of rows A and B connected to gate line 101, are raised to the high inversion state value by coupling through their capacitors C of the bootstrap pulse. Pixels of matrix rows A and B connected to gate line 102 are unaffected by the rising edge of bootstrap pulse 138 (except transiently) because their transistors are still on, clamping them to their data lines. These pixels of matrix rows A and B connected to gate line 102 remain in the low inversion state into which they were placed by the voltage on their data line. Likewise, in frame T1, a gate pulse 133 appears on gate line 103 at time t3 and a gate line pulse 134 appears on gate line 104 at time t5. While these gate pulses are up, the corresponding pixel electrodes are charged to corresponding data line voltages through the pixel transistors Q. While both gate pulses are present (alternatively, immediately before one or both), the voltage 139 on bootstrap lines C and D falls. At this time, the pixel electrodes are clamped to the corresponding data lines through the transistors, so their voltages are unaffected (except transiently). At the time gate line pulse 133 ends but the gate line pulse 134 remains high, transistors of pixels in matrix rows C and D that are connected to gate line 103 turn off (FIG. 3). As shown, the bootstrap voltage signal 139 on bootstrap lines C and D rises, thus, the pixel electrode potentials 149 for pixels of rows C and D connected to gate line 103, are raised to the high inversion state value by coupling through their capacitors C of the bootstrap pulse. Pixels of matrix rows C and D connected to gate line 104 are unaffected by the rising edge of bootstrap pulse 139 (except transiently) because their transistors are still on, clamping them to their data lines. These pixels of matrix rows C and D connected to gate line 104 remain in the low inversion state into which they were placed by the voltage on their data line. It should be understood that the description of the timing of gate/bootstrap pulses as applied to pixels of rows A–D in frame T1 similarly apply to the timing of gate pulses 135,136 and bootstrap pulse 140 applied to matrix pixels of rows E and F. The pixel inversion voltages 150 for matrix pixels of rows E and F is shown in FIG. 4, relative to the timing of gate pulses 135,136 and bootstrap pulse 140.

As further shown in FIG. 4, the next frame T2 begins at time t6. However, the relative timing of pulses 131 and 132 on respective gate lines 101 and 102 are reversed compared to the timing of pulses 131 and 132 on gate lines 101 and 102 of the first frame T1. Particularly, in Frame 2, the pixels at gate line 101 are charged to the low inversion state and stay there, while those of gate line 102 are raised to the high inversion state by the positive edge of the bootstrap pulse voltage at t8. Likewise, in frame T2, the relative timing of pulses 133 and 134 on respective gate lines 103 and 104 are reversed compared to the timing of pulses 133 and 134 on gate lines 103 and 104 during the first frame T1, and similarly for gate line pulses 135, 136 in gate lines 105 and 106. As shown in FIG. 4, the following frame T3 has the same timing and resulting states as the first frame T1. It should be understood that the timing of all gate pulses throughout the active matrix is reversed by pairs during frame T2 and every succeeding second frame (i.e., T2, T4, T6, . . . etc.) as compared with the timing of the prior gate pulses generated during a respective immediate prior frame, (i.e., T1, T3, T5, . . . etc.).

FIG. 4 shows gate pulses on successive gate lines overlapping in time; however, it is known in the art that gate pulses may be either overlapping or non-overlapping; each method having well known advantages and disadvantages.

In further view of FIGS. 3 and 4, it follows that the AMLCD structure of the invention has a single-pixel checkerboard pattern of inversion states with each state reversing in each frame. It should be apparent that one skilled in the art may modify the array of FIG. 3 to provide checkerboard patterns of inversion states, other than single pixel checkerboards, without departing from the spirit of the invention; for instance, a checkerboard with 4-by-4 pixel region in each inversion state.

Given the staggered time arrangement of gate line pulses every other frame, the data voltage supplied to each pixel on data lines 120 in each frame must be appropriate to the desired luminance and the new inversion state. As a consequence of the change in gate pulse sequence in every second frame, as shown in FIG. 4, the flow of data to the display must be correspondingly modified in every second frame. In FIG. 4, during frame T1, data for pixels at row A, columns a, c, . . . and for pixels at row B, columns b, d, . . . (FIG. 3) must be present on the data lines when gate pulse 131 falls at time t3. Subsequently, also in frame T1, data for pixels in row B, columns a, c . . . , and for pixels in row A, columns b, d . . . must be present on the data lines when gate pulse 132 falls at time t5. This type of sequence of data continues as the sequential application of gate pulses continues, and applies as well to subsequent frames T3, T5, etc.

By contrast, during frame T2 and subsequent frames T4, T6, etc., the sequence of gate pulses reverses by pairs of gate lines, so the data sequence must correspond. That is, data for pixels in row B, columns a, c, . . . , and for pixels in row A, columns b, d, must be present first, at the time of the fall of gate pulse 132 (frames T2, T4, etc . . . ). Subsequently, data for pixels in row A, columns a, c, . . . , and in row B, columns b, d, . . . , must be present at the time of the fall of gate pulse 131 (frames T2 . . . ), and so on.

It should be understood that due to the interleaving of gate line connections in the preferred embodiment, the sequence of data presented to the data lines differs in all frames from that which is present in prior art displays. In the prior art, data for all pixels of a single row are applied to the data lines at a given time, while in the preferred embodiment of the invention (FIG. 3), data for half the pixels in each of a pair of rows are applied at a given time. Thus, the data flow from the display's frame buffer memory (not shown) must differ from the prior art, either by means of the design of the frame buffer or by means of data resequencing circuitry in the path from the frame buffer to the display. Data resequencing means are well known in the display electronics art.

Although the voltage state of each pixel is erroneous during brief intervals, for instance, between times t1 and t4 for pixels of rows A and B, gate line 101, in arrays with very large numbers of rows, the duration of these intervals of error is negligibly short.

The operational distinctions of the bootstrapped pixel inversion method of the preferred embodiment as compared to the bootstrapped pixel inversion method of the first embodiment (FIG. 2), is that the bootstrap pulses 138, 139 and 140 of the preferred embodiment occur at the frame frequency rather than half the frame frequency, and that in the preferred embodiment all pixels of a pair of rows are served by bootstrap pulses of the same timing, so no interleaving of bootstrap electrodes is necessary. Furthermore, the relative sequence of gate pulses on pairs of gate lines reverses every second frame.

In silicon-based reflective light valves, an effective circuit layout comprises having the bootstrap lines on a first polysilicon layer while the pixel electrode structure includes a capacitor plate on a second polysilicon layer to achieve the maximum capacitance to the bootstrap line. If all gates and gate lines are on the first poly, metal crossovers are used to obtain the alternating gate connections of FIG. 3. If transistors have second poly gates, one of the gate lines of each pair may be the second poly so crossovers would not require poly-to-metal contacts. Additionally, the circuit structure is such that the capacitive coupling between gate lines of each pair is minimized.

Figure 5:
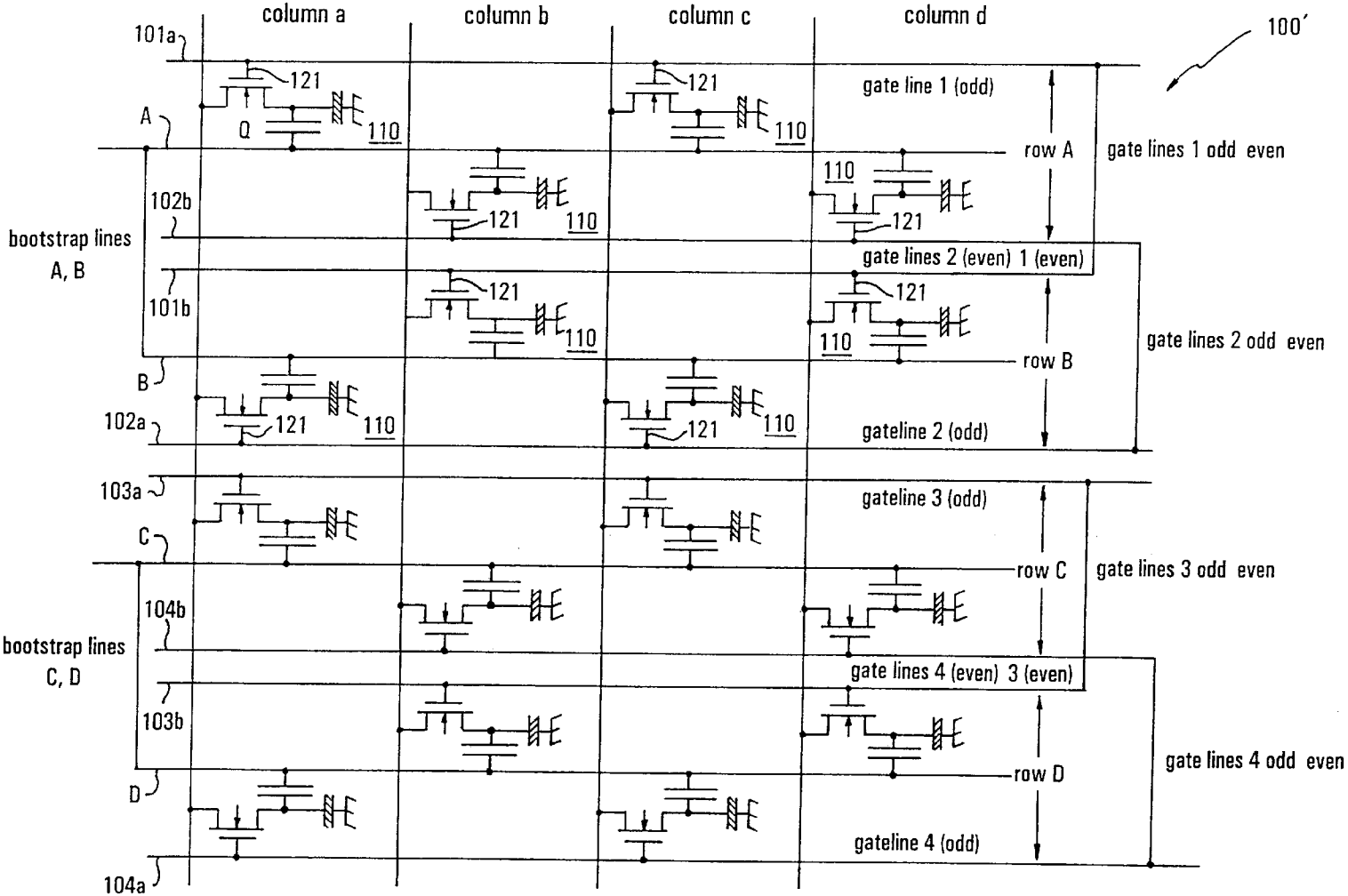
FIG. 5 depicts an alternative layout for pixel inversion scheme of FIG. 3.

FIG. 5 depicts an alternative layout 100' for pixel inversion scheme of FIG. 3. Its advantage is that gate line connections do not cross each other within the array as in the embodiment of FIG. 3. Rather, in the embodiment of the invention depicted in FIG. 5, two gate lines, e.g., 101*a,b*, 102*a,b*, 103*a,b*, . . . etc., are required per pixel row throughout the array 100', the two gate lines per pixel row being connected together and subject to the same timing as shown in the diagram of FIG. 4. For instance, in the pixel inversion circuit layout 100' avoiding cross-overs as shown in FIG. 5, the gate terminals 121 of the row A, column a, c, . . . pixels 110 are connected to gate line 101*a*, and the gate terminals of the row B, column b, d, . . . pixels 110 are connected to gate line 101*b*. Gate lines 101*a*, and 101*b* may be subject to the same pulse sequencing from a single source (not shown). Likewise, the gate terminals 121 of the row A, column b, d, . . . pixels are connected to a gate line 102*b*, and the gate terminals of the row B, column a, c, . . . pixels are connected to gate line 102*a* with gate lines 102*a*, and 102*b* subject to the same pulse sequencing from a single source (not shown). This is in contrast to the regular pixel inversion scheme of FIG. 3, where the same pixels having gate terminals connected to gate lines 101*a* and 101*b* in FIG. 4, have gate terminals connected to the single gate line 101. The expense of avoiding cross-overs in pixel inversion is that an enlargement of the array is required.

Figure 6:
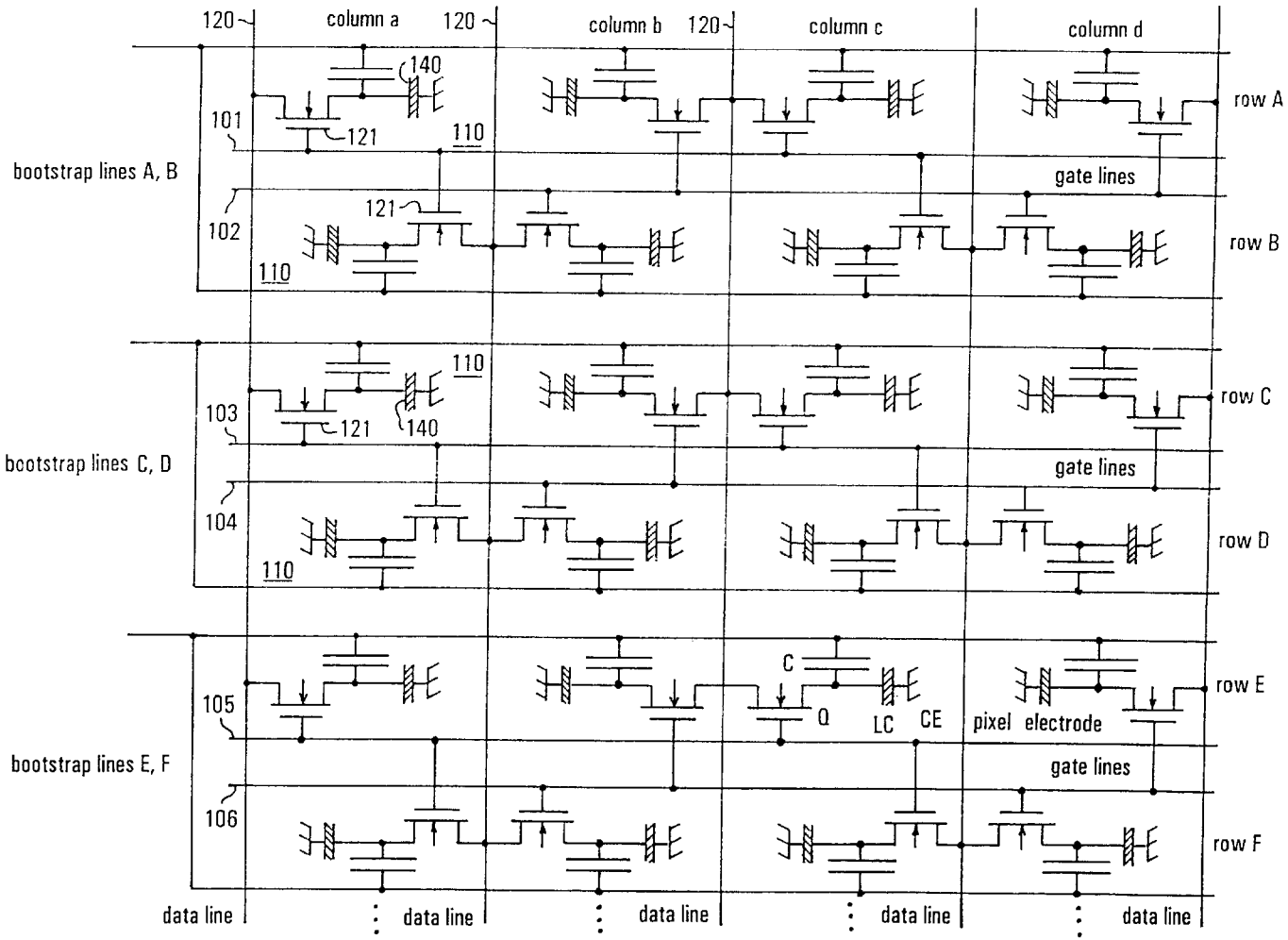
FIG. 6 illustrates the AMLCD display apparatus incorporating column inversion with the bootstrapped method.

As an alternative to row inversion and the pixel inversion shown in FIG. 3, the AMLCD bootstrapped inversion method may be implemented with a column inversion scheme, a circuit layout of which is depicted in FIG. 6. In column inversion, as shown in FIG. 6, all pixels 110 of a particular column of the matrix are in the same inversion state at the end of a frame. That is, all pixels in a column, e.g., Column a, and alternating columns therefrom (column c, e, . . . , etc.), are connected to odd numbered gate lines, e.g., gate lines 101, 103, 105, etc.; while all pixels in Column b and alternating columns therefrom (column d, f, . . . , etc.), are connected to even numbered gate lines, e.g., gate lines 102, 104, 106, etc. Thus, the column inversion states alternates spatially by column. The distinction of the bootstrap inversion methodology incorporating column inversion is that the inversion states form vertical stripes in contradistinction to the preferred pixel inversion method where inversion states form a checkerboard pattern. The timing and waveform diagram for the embodiment implementing column inversion, as shown in FIG. 6, are the same as described with respect to FIG. 4 as the pixel waveforms are labeled in FIG. 4 according to the gate lines the pixels are connected to. The same principle of avoiding cross-overs as described with reference to FIG. 5, is additionally applicable to AMLCD displays implementing column inversion.

While the invention has been particularly shown and described with respect to illustrative and preferred embodiments thereof, it will be understood by those skilled in the art that the foregoing and other changes in form and details may be made therein without departing from the spirit and scope of the invention which should be limited only by the scope of the appended claims.

What is claimed is:

1. A display comprising:

a plurality of pixel assemblies arranged in a matrix of rows and columns, each of said pixel assemblies including a display element having a display electrode, and a semiconductor device having a control port, an input port and an output port, each of said output ports being connected to a corresponding display electrode;

a plurality of bootstrap lines, each bootstrap line connected to said display electrodes of at least one row of said pixel assemblies;

a plurality of data lines each connected to said input ports arranged in one of said column;

a plurality of gate lines with each gate line associated with a row of pixels in said matrix and connected to control ports of pixel assemblies in said row for receiving gate line pulses, said control ports of semiconductor devices associated with pixels located on two adjacent rows being alternately connected to either one of two associated gate lines in an interleaved fashion; and a bootstrap pulse timing and generating circuit connected to each bootstrap line to provide a bootstrap pulse in timed relation with gate line pulses applied to each of two gate lines associated with said pixels of two adjacent rows, wherein said timing relationship causes display electrodes of alternately connected interleaved pixels of said two adjacent rows to shift in voltage in a first time frame and successive time frames, and enabling display electrodes of remaining alternately connected interleaved pixels of said two adjacent rows of pixels to shift in voltage in a second time frame and successive second time frames.

2. The display of claim 1, wherein in each time frame, each said bootstrap pulse timing and generating circuit connected to a bootstrap line provides bootstrap pulses each having a first edge of a first polarity occurring one of before and during gate pulses carried on each of two gate lines associated with said two adjacent pixel rows, and a second edge of a second polarity occurring after completion of one of said gate line pulses, wherein interleaved pixels connected to said gate line of a completed gate line pulse change voltage state in a first direction in response to said second edge.

3. The display of claim 2, wherein gate line pulses applied to interleaved pixels associated with a first gate line for a row of pixels occur in overlapped relation with gate line pulses applied to interleaved pixels associated with a second gate line connecting an adjacent row of pixels, said gate line pulse applied to said first gate line occurring prior to said gate line pulse applied to said second gate line of said adjacent row in said first time and successive first time frames.

4. The display of claim 3, wherein in a second and successive second time frames, said gate line pulse applied to said second gate line occurs prior to said gate line pulse applied to said first gate line of said adjacent row.

5. The display of claim 1, wherein each of said bootstrap lines is capacitively connected to said display electrodes in said adjacent rows.

6. The display of claim 1, wherein said semiconductor devices are thin film transistors.

7. The display of claim 1, wherein said semiconductor devices are metal-oxide-semiconductor field effect transistors.

8. A method of driving an active matrix liquid crystal display including a plurality of pixel assemblies arranged in a matrix of rows and columns, each of said pixel assemblies including a display element having a display electrode, and a semiconductor device having a control port, an input port and an output port, each of said output ports being connected to a corresponding display electrode, said method comprising the steps of:

generating gate pulses on gate lines each connected to control ports of semiconductor devices of said pixel assemblies arranged in said rows, said control ports of semiconductor devices associated with pixels located on two adjacent rows being alternately connected to either one of two associated gate lines in an interleaved fashion;

generating data pulses on data lines each connected to input ports of said semiconductor devices arranged in said columns; and, generating a bootstrap pulse on bootstrap lines each connected to display electrodes of at least one row of a plurality of display elements of pixel assemblies, said bootstrap pulse being generated in timed relation with said gate line pulses applied to said two gate lines associated with said pixels of two adjacent rows, said timed relation causing display electrodes of alternately connected interleaved pixels of said two adjacent rows to shift in voltage in a first time frame and successive time frames, and enabling display electrodes of remaining alternately connected interleaved pixels of said two adjacent rows of pixels to shift in voltage in a second time frame and successive second time frames.

9. The method of claim 8, wherein said bootstrap pulse generating step generates said bootstrap pulse having a first edge of a first polarity occurring one of before and during gate pulses carried on said gate lines, and a second edge of a second polarity occurring after completion of one of said gate line pulses, wherein interleaved pixels connected to said gate line of a completed gate line pulse change voltage state in a first direction in response to said second edge.

10. The method of claim 9, wherein said step of generating gate line pulses includes applying a first gate line pulse to interleaved pixels associated with a first gate line for a row of pixels and a second gate line pulse to interleaved pixels associated with a second gate line for an adjacent row of pixels, said first and second gate line pulses being generated in overlapping relation wherein said gate line pulse applied to said first gate line occurs prior to said gate line pulse applied to said second gate line of said adjacent row in said first time and successive first time frames.

11. The method of claim 10, wherein in a second and successive second time frames, the step of generating said second gate line pulses in overlapping relation with and prior to generating said first gate line pulses.

* * * * *